US010773853B2

(12) United States Patent
Jongsma et al.

(10) Patent No.: US 10,773,853 B2
(45) Date of Patent: Sep. 15, 2020

(54) FOIL FOR CLOSING AN OPENING OF A CONTAINER, A CONTAINER PART AND A CONTAINER, AND A METHOD AND APPARATUS FOR MAKING SAME

(75) Inventors: Jelmer Jongsma, Deventer (NL); Johan Willem Roeterdink, Epse (NL)

(73) Assignee: Ardagh MP Group Netherlands B.V., Deventer (NL)

( * ) Notice: Subject to any disclaimer, the term of this patent is extended or adjusted under 35 U.S.C. 154(b) by 619 days.

(21) Appl. No.: 13/519,485

(22) PCT Filed: Dec. 22, 2010

(86) PCT No.: PCT/EP2010/070533
§ 371 (c)(1),
(2), (4) Date: Nov. 12, 2012

(87) PCT Pub. No.: WO2011/080182
PCT Pub. Date: Jul. 7, 2011

(65) Prior Publication Data

US 2013/0112690 A1 May 9, 2013

(30) Foreign Application Priority Data

Dec. 31, 2009 (EP) ..... 09075580

(51) Int. Cl.

| | |
|---|---|
| ***B65D 17/353*** | (2006.01) |
| ***B65D 17/00*** | (2006.01) |
| ***B65D 17/50*** | (2006.01) |
| ***B65D 17/28*** | (2006.01) |
| ***B21D 51/44*** | (2006.01) |

(52) U.S. Cl.
CPC ..... *B65D 17/12* (2013.01); *B21D 51/443* (2013.01); *B65D 17/28* (2018.01); *B65D 17/502* (2013.01); *B65D 2517/5013* (2013.01); *B65D 2517/5027* (2013.01); *B65D 2517/5083* (2013.01)

(58) Field of Classification Search
CPC ..... B65D 77/2032; B65D 2577/205; B65D 17/163; B65D 17/165; B65D 17/16; B65D 17/502; B65D 2517/5078; B65D 2517/0013
USPC ..... 220/359.2, 270, 266, 265, 269, 268; 215/255, 254, 253, 250, 232, 305, 295
See application file for complete search history.

(56) References Cited

U.S. PATENT DOCUMENTS

| | | | | |
|---|---|---|---|---|
| 3,359,773 A | | 12/1967 | Stuchbery | |
| 4,212,395 A | * | 7/1980 | Korte | B65D 83/0847 229/237 |
| 5,094,357 A | | 3/1992 | McKinney | |
| 5,119,964 A | | 6/1992 | Witt | |

(Continued)

FOREIGN PATENT DOCUMENTS

| | | | |
|---|---|---|---|
| EP | 1321376 | A1 | 6/2003 |
| JP | H04215969 | A | 8/1992 |
| WO | 2009065623 | A1 | 5/2009 |

*Primary Examiner* — Allan D Stevens
(74) *Attorney, Agent, or Firm* — The Webb Law Firm

(57) ABSTRACT

A foil for closing an opening in a container, such as an easy opening container, includes foil to be adhered to the container. The foil includes a tab for releasing the foil from the container. The tab is folded on the foil and connected thereto via a connector and the tab is provided with a breakout device such that upon actuating the tab a visible and irreparable broken out part is formed and adhered to the foil.

7 Claims, 4 Drawing Sheets

(56) References Cited

U.S. PATENT DOCUMENTS

| | | | | |
|---|---|---|---|---|
| 5,205,454 | A * | 4/1993 | Schutz | A47K 10/16 206/409 |
| 5,579,943 | A * | 12/1996 | Johnson | B65D 51/20 215/239 |
| 7,766,183 | B2 * | 8/2010 | Wallis et al. | 220/359.2 |
| 2005/0045633 | A1 * | 3/2005 | Roeterdink et al. | 220/254.1 |
| 2009/0277814 | A1 * | 11/2009 | Hamerly et al. | 206/526 |
| 2011/0000914 | A1 * | 1/2011 | Jouillat | 220/270 |

* cited by examiner

FOIL FOR CLOSING AN OPENING OF A CONTAINER, A CONTAINER PART AND A CONTAINER, AND A METHOD AND APPARATUS FOR MAKING SAME

BACKGROUND OF THE INVENTION

1) Field of the Invention

The present invention relates to a foil for closing an opening in a container, such as an easy opening container, to a method and apparatus for making such foil, and to a container part and a container provided with such a foil.

2) Description of Related Art

In a packaging for food and similar products a foil is frequently used for closing the opening to the content of the container. The opening is generally tightly closed by the foil. Still the foil is normally removed and the opening and the content exposed without the application of a high force by the user. The foil is rather fragile and for particular applications it is required that after filling and closing the container the foil is protected by a protective rigid over closing cap against undesired impacts that would break the foil and spoil the content.

The vulnerable foil has as a drawback that it might be opened and reclosed without being visibly noticeable. This could result in a situation that the content of the container is no longer the genuine content and that the content quality has been changed, degraded or even turned toxic by manipulation by third parties. This may generate claims in relation to the inferior content of the container. Claims in may circumstances unjustified but often difficult to counter.

Accordingly, much efforts have already been spent in improving the tamper proof quality of containers provided with a foil. For instance, WO2009/065623 of applicant discloses a container provided with a foil and the tab for removing the foil from the container for exposing the container content is provided with temper proof means. These temper proof means may have the form of a part of the tab or the foil which remains separate form tab or foil and provides an indication that the tab was used for releasing the foil form the container.

For many applications this container provided with temper proof means provides a sufficient safe guard against undesired opening and reclosing after intermediate exposure of the content. Which intermediate exposure may result directly or indirectly due to manipulation of the content to its change in quality. Still the reclosing of the foil may be done such carefully that it remains unnoticeable even at closer inspection.

In particular situations, such as containers comprising powdered baby food, the degree of security of being able to notice unwanted intermediate exposure of the content and degree of safety that the content is still genuine is not yet good enough.

SUMMARY OF THE INVENTION

Accordingly, the present invention has for its object to provide a container, container part and a foil therefore which are provided with temper proof means which provide almost complete certainty that any release or even partial release of the foil from the container of container part with exposure of the content is always visible and cannot be restored and repaired. Due to the constant visibility of the used tab and the (partially) released foil provides certainty that the content of the container is still genuine. This is particularly the case because the damage resulting from using the tab for opening the container by removing the foil cannot be repaired. Once the tab has been used of (partially) opening the container the temper proof means have been subject to a damaging action which remains visible and cannot be repaired.

These objectives are met and possible problems avoided or overcome with a foil according to the invention, which foil to be adhered to the container comprises a tab for releasing the foil from the container, wherein the tab is folded on the foil and connected thereto via a connector and wherein the tab is provided with breakout means such that upon actuating the tab a visible and irreparable broken out part is formed and adhered to the foil.

The improved security against undesired opening and closing without notice is obtained by the incorporation of a connector for securely connecting the folded over tab to the foil and the incorporation of the temper proof means. Thus, when gripping and lifting the tab for opening the foil the temper proof means are visibly damaged by the break out means in such a manner that they cannot be repaired without the repair being easily noticeable. Thereto the force for damaging the temper proof means for breaking out the part left visible is lower than the force for releasing the tab by disconnecting the connector. This provides a double security that any opening of the container by actuating the tab and lifting it form the foil remains thereafter visible and repair is not possible.

According to a first embodiment of the invention are the breakout means incorporated in the tab. This provides the advantage that the break out means can be incorporated in the tab and no additional elements and/or materials are required for installing the temper proof means according to the invention.

When incorporated in the tab the breakout means preferably have the form of at least one weakened tab part or at least one opening in the tab. With such break out means the force required for breaking out the tab part is very low. So that any delicate manner of actuating the tab will remain visible. In addition the force with which the tab is connected with the foil may also be reduced (but higher than the break out force) so that it is feasible to use a releasable connector for connecting the tab to the foil. This makes the implementation of the break out means in other existing foil types possible without major changes. The lowest force for breaking out is possible if the break out means have the form of at least one opening in the foil. This opening may have any form but preferably has an elongated form. The form of a slot may be very narrow even with abutting slot edges. For optimal guiding the breaking out of the tab part the weakened tab part and/or the opening extend in the direction of the intended breaking out direction. When the breaking out occurs at two separate locations, such as at both sides of the connector the directions preferably converge and coincide thereby forming in a controlled manner the broken out part residing within the tab and do not interfere with the function of the tab.

As stated above, it is generally sufficient that at a location in the tab the breaking out of the tab part is initiated and ultimately completed without destruction of the tab loosing its tab function of lifting the foil from the container. Thus it is generally sufficient that the weakened tab part or opening is located in at least the area between a tab free end and the connector. In this area the force for breaking out is first met and here the initiation of the breaking out of the tab generally starts.

In order the control and guide the breaking out if the tab part while maintaining the tab integrity it is preferred that a weakened tab part or opening is located at at least one lateral side of the connector. Obviously, the best manner in controlling and guiding the breaking out of the tab part is feasible when a weakened tab part or opening is located in at least the area between a tab free end and the connector and a weakened tab part or opening is located at both lateral sides of the connector.

As indicated above it is generally preferred when the directions of breaking out converge beyond the connector. Accordingly, the tab part broken out surrounds the connector thereby forming a hole in the tab in a controlled manner and with an intended seize so that with the broken out tab part removed the tab integrity is maintained such that it still functions as a genuine tab for lifting the foil from the container for exposure and access to the container content.

The foil according to the invention is applicable with any conventional type of container provided with a foil for closing off an opening of the container. The foil made be adhered to the container by any conventional means such by adhesive or by sealing. The foil may be attached directly to the container at an outer rim or edge or at a groove formed in the container body. In the alternative the foil may first be mounted on a ring or annular element which is adhered to the container at its edge or body groove. The container may be of any size having a circular, oval, annular, square or rectangular opening. For cylindrical containers any diameter may be provided with a foil of the invention, such as a diameter of 99 mm and 121 mm. The foil may be made of metal, such as steel, tin plate and aluminium, optionally provided at at least one side with a polymer coating such as an polyethylene polypropylene or mixture thereof, or of a polymeric material (of the mentioned polymeric materials) optionally provided with a metal outer layer at one or both sides. Additionally adhesive or heat seal material be may used for adhering the foil directly or indirectly to the container.

The mounting of the foil to the container of with the ring to the container may take place before or after filling the container.

The foil may be of such strength that it may carry a spoon and/or product information leaflet without being deformed or damaged. Accordingly, the user is provided with means for optimal use of the content without interference by the implemented foil of the invention.

Another aspect of the invention relates to a method for making the a foil according to the invention. This method comprises the steps of:

i. providing a foil or foil strip;
ii. forming the break out means and tab in the foil or foil strip;
iii. folding tab onto the foil or foil strip;
iv. forming in the foil and folded tab a connector for connecting the tab to the foil via the connector; and
v. optionally forming at a step the foil out of the strip.

The various steps are carried out in standard unit or stations of an apparatus for producing a foil, a foil mounted on a container part or on the container directly. It is the possible to start with a foil or to start with a foil strip out of which the foil is subsequently to formed by for instance cutting. In this foil or foil strip the break out means in the form of for instance a weakened part, a perforation or an opening are applied as well as the tab. It is possible to first form the break out means and then the tab. The reverse order of making as well as simultaneous making both is also possible. After formation of the break out means and the tab, the tab is folded over and on the foil. Thereafter the tab is connected to the foil via a connector.

This connector may have the form of any suitable permanent or releasable connector provided that the breaking out of the tab part remains guaranteed. Preferably the connector is formed out of the material of the foil and/or the tab. Thereto foil and tab are deformed by stretching providing the additional material for forming a form closing connection by interconnected foil and tab parts, see for instance EP 1 321 376.

Finally, if the tab and break out means have been formed in a foil strip, the foil is cut out of the foil strip. It is repeated that these steps may be carried out in any order or even coincide as long as the function of the tab and the temper means is guaranteed. Still it is preferred that the break out means are formed in the foil prior to the formation of the tab. This provides better conditions for forming the weakened part(s) and/or opening(s) in a controlled manner using forming or cutting means while the foil or foil strip is support.

In the alternative the method for making a foil according to invention comprises the steps of:

i. providing a foil or foil strip;
ii. folding tab onto the foil or foil strip;
iii. forming in the folded tab break out means and a connector for connecting the tab to the foil via the connector; and
iv. optionally forming at any step the foil out of the foil strip.

This method is more delicate because the breaking out means are formed in an already completely formed, folded and connected tab. This means that the formation of the break out means should take place without damaging the underlying foil which is also to support the folded on tab. The advantage is that the break out means of the invention may be formed in conventional foils provided with the folded tab in an additional step of forming the break out means and if necessary the connector. Therefore it is preferred that the break out means are formed in the folded tab, such as by laser means or mechanical means. Leaser means are preferred because the formation of the break out means of the invention can takes place without physical contact with the tab and foil.

In an alternative the breakout means may have the form of an adhesive strip formed by applying an adhesive tape on the tab and laterally at at least one tab side to the foil. This strip is torn apart at one or both sides of the tab when the tab is lifted leaving a broken out part of the adhesive visible on the tab and on the foil adjacent to the original location of the folded tab. In the method of the invention such tape is applied on the tab and extends at least at one side of the tab laterally thereof and is adhered to the foil.

According to another aspect the invention relates to container ring and/or container, having an opening closed by a foil of the invention and/or has been made by the method of the invention described above.

A final aspect of the invention relates to an apparatus designed for making a foil of the present invention.

BRIEF DESCRIPTION OF THE DRAWINGS

Mentioned and other features and advantages of the present invention will be apparent from a description of several embodiments of the present invention which description will be given for information purposes without the intention to limit the invention thereto. Reference will be made to the annexed drawings wherein.

DETAILED DESCRIPTION OF THE PREFERRED EMBODIMENTS

Figure 1:
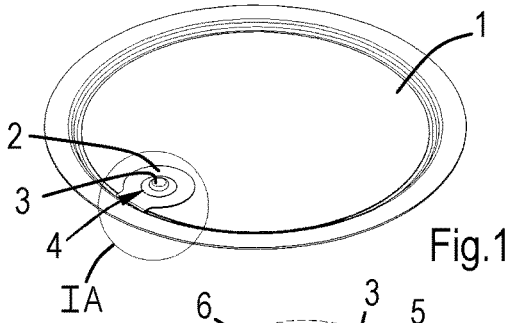
FIG. 1 is a perspective view of ring provided with a foil of the invention.
Figure 1A:
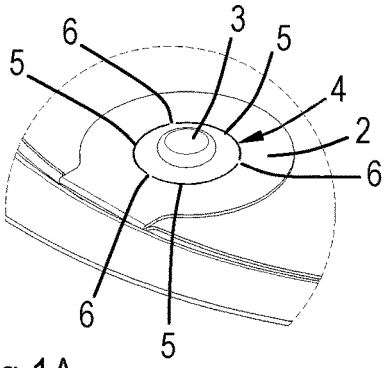
FIG. 1A is at a larger scale detail I in FIG. 1.

FIGS. 1 and 1A show a foil 1 of the invention. The foil 1 is provided with a folded on tab 2. The tab 2 is connected to the foil via a connector 3. The tab 2 is provided with break out means 4 incorporated in the tab 2 and having the form of three curved elongated openings or slots 5 surrounding the connector 3 and with tab bridges 6 in between.

Figure 2:
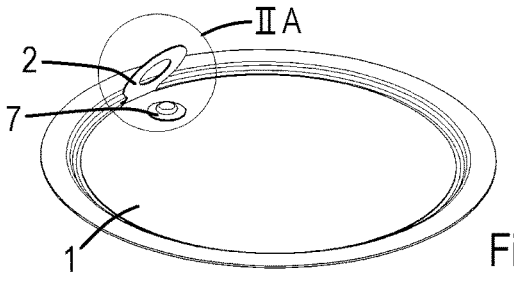
FIGS. 2 and 2A correspond to the FIGS. 1 and 1A with the tab in the lifted position and the visible broken out part.
Figure 2A:
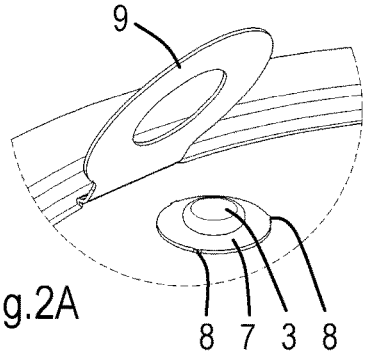

FIGS. 2 and 2A show the foil 1 of the invention when the tab 2 has been lifted from the foil 1. A tab part 7 is broken out of the tab 2 which part 7 remains connected to the foil 1 by the connector 3. In the tab part 7 are still visible remnants 8 of the tab bridges 6. In the tab 2 has been formed an opening 9. Still the tab 2 can perform its tab function without any hinder. It will be understood that for breaking the tab bridges 6 hardly any for is required by the user and that thereafter the partially destructed tab 2 cannot be repaired and the broken out part 7 remains clearly visible.

Figure 3:
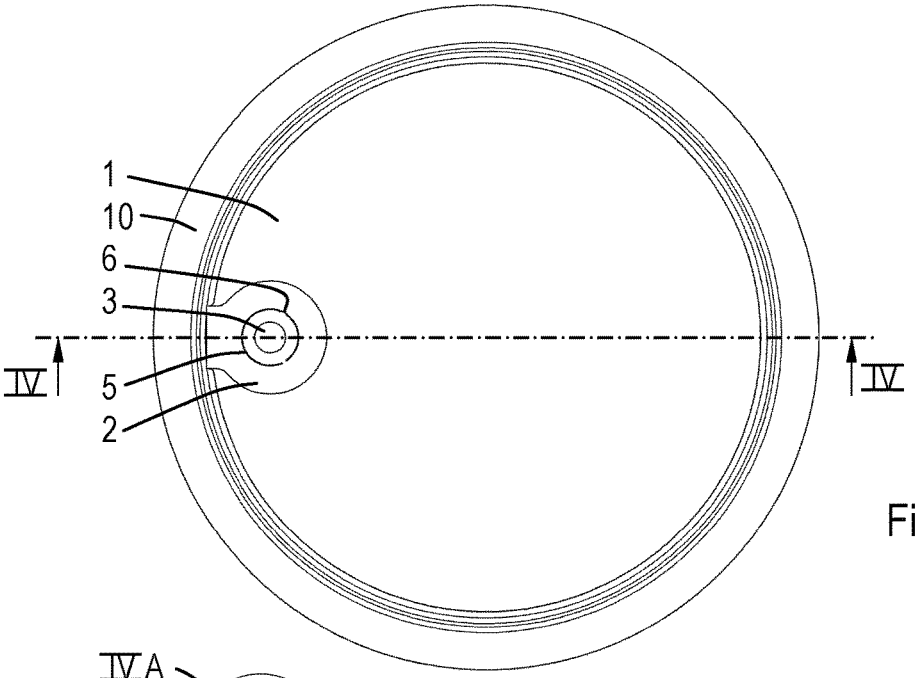
FIG. 3 at a larger scale a top view of the ring shown in FIG. 1.
Figure 4:
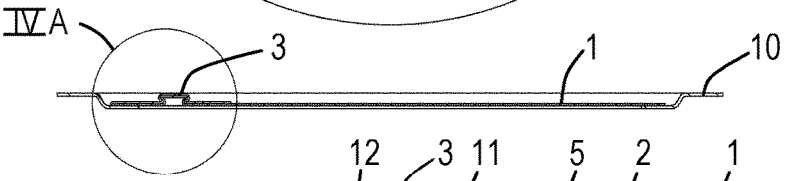
FIG. 4 is a cross section along the line IV-IV in FIG. 3.
Figure 4A:
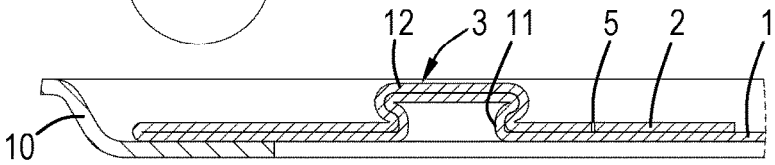
FIG. 4A is at a larger scale detail IV-A in FIG. 4.

As shown in FIG. 3 is the foil 1 mounted on a ring 10 to be mounted on the body of a container before filling the container via an open bottom or after filling the container. FIGS. 4 and 4A show in more detail that the connector resides within the confinement of the ring 10. The connector 3 is formed by a generally "T" shaped part 11 formed in foil 1 by stretch elongation. This "T" shaped part 11 extends in a complementary "T" shaped cavity 12 formed formed in the folded over tab 2. This combination of the parts 11 and 12 forms an so called form closing connection which is in essence releasable. But the required force is much greater than the force required for breaking apart the bridges 6. Obviously, this connector 3 could be made non-releasable by deforming the parts 11 and 12. If desired other types of connectors may be used as long as the breaking out function is secured.

Figure 5:
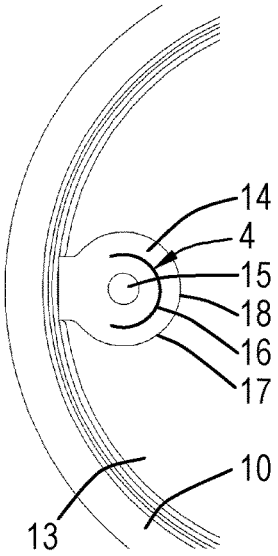
FIGS. 5 and 6 show other embodiments of the ring provided with a foil of the invention.

FIG. 5 shows another embodiment of the invention. A foil 13 is mounted on the ring 10 and the folded on tab 14 is provided with break out means 4 having the form of a substantially circular opening or slot 16 surrounding the permanent connector 15. The slot 16 is present in the region 17 between the free end 18 of the tab 14 and the connector 15. Again hardly any force in required by the user when lifting to tab 14 for breaking out the part of the tab 14 which is between the tab 14 and the foil 13.

Figure 6:
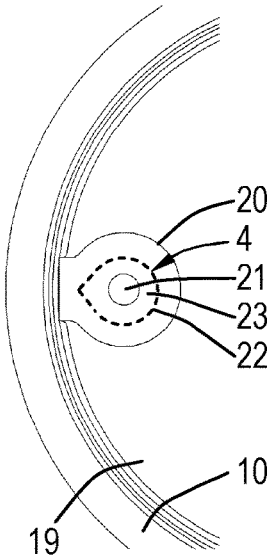

In the embodiment of FIG. 6 the foil 19 is mounted on the ring 10 and provided with a tab 20 connected to the foil 19 via the connector 21. The break out means 4 have the form of a perforation which encircles the connector 21 and have a generally droplet form so that the breaking out of the tab part 23 encircled by the perforation 22 converges.

Figure 7:
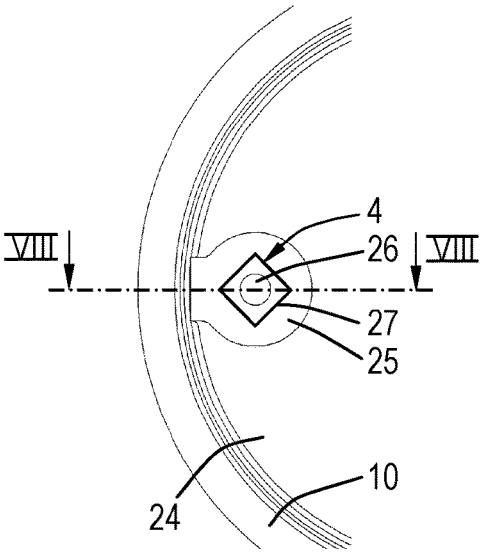
FIGS. 7, 8A and 8B show still another embodiment of the invention.
Figure 8A:
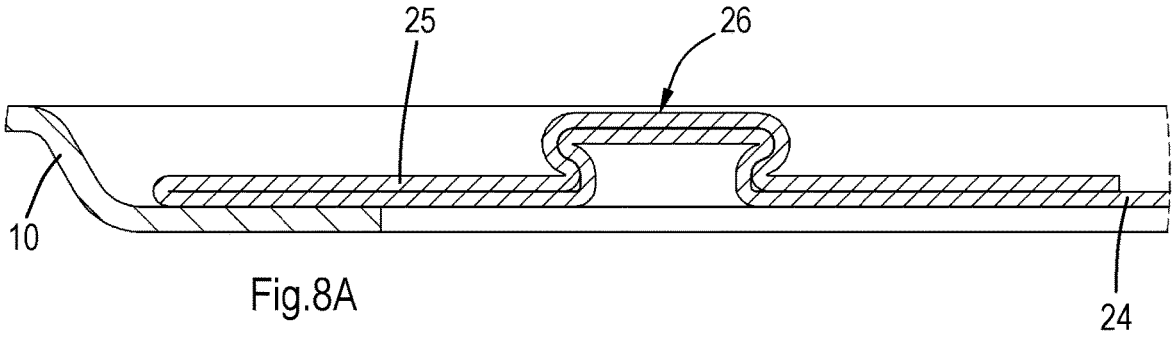
Figure 8B:
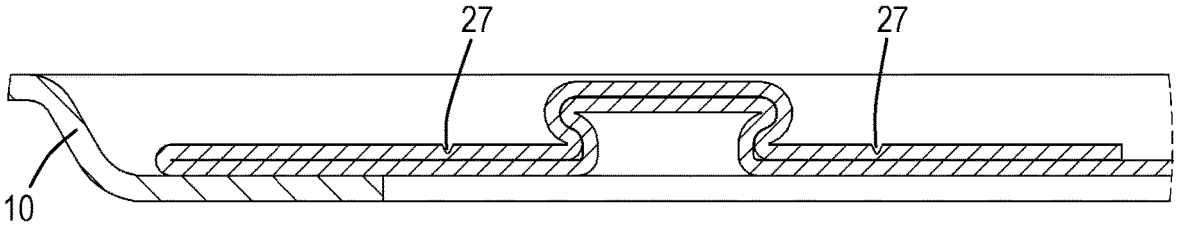
Figure 9:
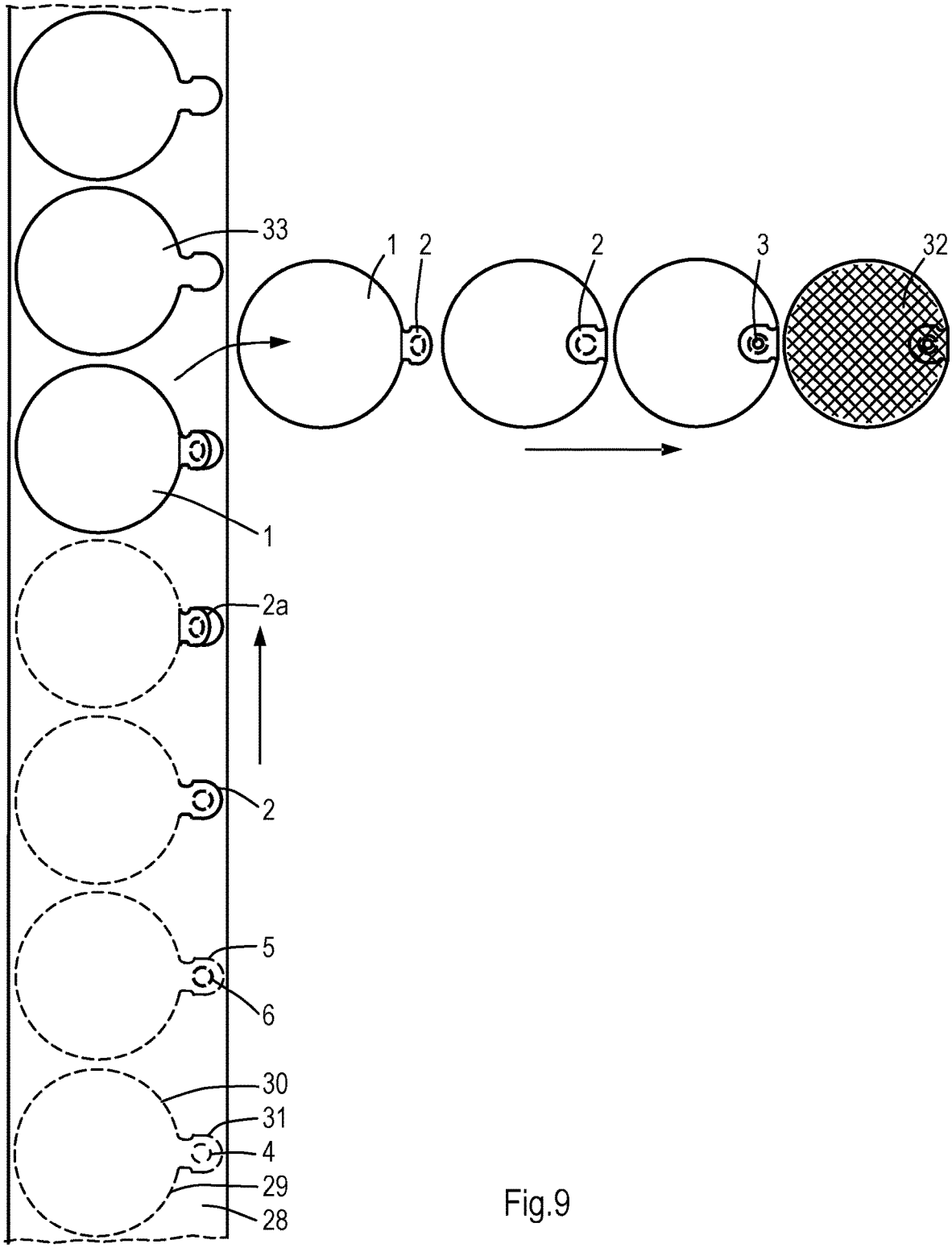
FIG. 9 shows schematically a method of the invention for making a foil of the invention made with laser means.

FIGS. 7, 8A and 8B show another embodiment of the invention. The foil 24 is mounted on the ring 10 by seaming or gluing and is provided with a folded on tab 25 connected thereto by the connector 26. The breakout means 4 of the invention comprise a weakened tab part 27 in the form of a rectangular weakening groove which was applied into the tab 25 after the tab 25 was mounted and folded on the foil 24. Still the integrity of the tab and the underlying foil 25 was preserved. The connector has the same form as the connector described in relation to FIGS. 4 and 4A.

FIG. 8 shows schematically an embodiment of a method and apparatus for making a foil of the invention, such as a foil 1 shown in FIG. 1.

A foil strip 28 is provided indicated is a phantom 30 of an entity 29 for the foil 1 and entity 31 for the tab 2. The foil strip 28 is passed into a station for making the break out means 4 first. This secures very safe operation later when forming the tab 2 and the connector 3. The three slots separated by the tab bridges 6 are formed with a cutting tool (not shown) while the foil strip 28 is supported. Subsequently in the next station the tab 2 is formed by cutting in the foil strip 28. Thereafter, optionally the tab 2 is brought in a slanted position so that the tab 2*a* is safely removed from the foil strip 28 together with the foil 1. In the next station is the foil 1 cut out of the foil strip 28 and is the strip transferred to a lateral station where the tab 2 is folded onto the foil 1 and thereafter the connector 3 formed. The foil 1 and tab 2 may be provided with a conventional waffle pattern 32. Thereafter the foil 1 may be mounted on a ring for a container or may be mounted directly on a rim or inner groove of a container.

Figure 10:
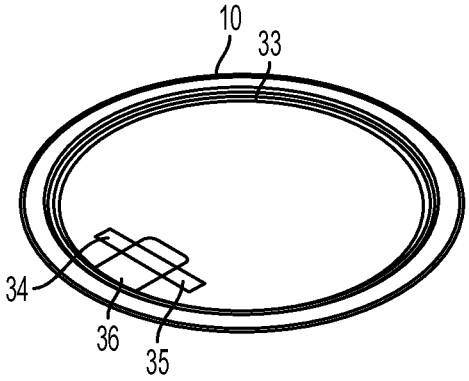
FIGS. 10 and 11 show another alternative of the invention.
Figure 11:
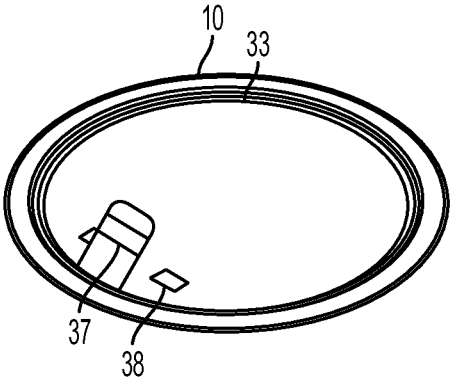

Finally, FIGS. 10 and 11 show another alternative of the present invention. The foil 33 mounted on the ring 10 is provided with a folded on tab 34. The breaking out means comprise an adhesive tape 35 which is adhered to the tab 34 and extends laterally at both sides and is also adhered to the foil 33. Upon lifting the tab the adhesive tape 35 breaks off at the weakened lines 36. This leaves a broken out part 37 visible in the tab 34 and broken out parts 38 on the foil 33. These broken out parts 37 and 38 remain visible and cannot be repaired.

The invention claimed is:

1. A foil for closing an opening in a container, such as an easy opening container, comprising foil to be adhered to the container, which foil comprises a tab for releasing the foil from the container, wherein the tab is folded on the foil and connected thereto via a connector; wherein the connector is a protrusion provided in the foil that extends into a complimentary cavity provided in the tab; wherein the tab is provided with breakout means that encircle the connector such that upon actuating the tab a visible and irreparable broken out part is formed and adhered to the foil and a hole is formed in the tab; wherein the breakout means are formed as at least one opening in the tab, wherein the at least one opening in the tab is formed as a first slot passing through the tab and located at a first lateral side of the connector and a second slot passing through the tab and located at a second lateral side of the connector such that the first slot and the second slot converge beyond the connector towards an end of the tab that is integrally connected to the foil and a third slot in an area between a free end of the tab and the connector, wherein the first slot extends a first length around the connector between a first tab bridge and a second tab bridge, the second slot extends a second length around the connector between the second tab bridge and a third tab bridge, and the third slot extends a third length around the connector between the third tab bridge and the first tab bridge such that the first slot, the second slot, and the third slot surround the connector, and wherein visible remnants of the tab bridges remain with the broken out part when the tab is actuated.

2. The foil according to claim 1, wherein the foil is made of metal, such as steel, tin plate and aluminum, optionally provided at at least one side with a polymer coating, or of a polymeric material.

3. A method for making the foil according to claim 1, comprising the steps of:

i. providing the foil or foil strip;

ii. forming the breakout means formed as at least one opening and tab in the foil or foil strip;

iii. folding the tab onto the foil or foil strip;

iv. forming in the foil and folded tab the connector for connecting the tab to the foil via the connector; and v. optionally forming at a step the foil out of the strip.

4. The method as claimed in claim 3, wherein the breakout means are formed in the foil prior to the formation of the tab.

5. A method for making the foil according to claim 1, comprising the steps of:

i. providing the foil or foil strip;

ii. folding the tab onto the foil or foil strip;

iii. forming in the folded tab breakout means formed as at least one opening in the tab and the connector for connecting the tab to the foil via the connector; and iv. optionally forming at any step the foil out of the foil strip.

6. The method as claimed in claim 5, wherein the breakout means are formed in the folded tab by at least one of laser means and mechanical means.

7. A container, having an opening closed by a foil to be adhered to the container, which foil comprises a tab for releasing the foil from the container, wherein the tab is folded on the foil and connected thereto via a connector; wherein the connector is a protrusion provided in the foil that extends into a complimentary cavity provided in the tab; wherein the tab is provided with breakout means that encircle the connector such that upon actuating the tab a visible and irreparable broken out part is formed and adhered to the foil and a hole is formed in the tab; wherein the breakout means are formed as at least one opening in the tab, wherein the at least one opening in the tab is formed as a first slot passing through the tab and located at a first lateral side of the connector and a second slot passing through the tab and located at a second lateral side of the connector such that the first slot and the second slot converge beyond the connector towards an end of the tab that is integrally connected to the foil and a third slot in an area between a free end of the tab and the connector, wherein the first slot extends a first length around the connector between a first tab bridge and a second tab bridge, the second slot extends a second length around the connector between the second tab bridge and a third tab bridge, and the third slot extends a third length around the connector between the third tab bridge and the first tab bridge such that the first slot, the second slot, and the third slot surround the connector, and wherein visible remnants of the tab bridges remain with the broken out part when the tab is actuated.

* * * * *